US005448678A

United States Patent [19]

Booton et al.

[11] Patent Number: 5,448,678

[45] Date of Patent: * Sep. 5, 1995

[54] ELECTRICALLY HEATED NOZZLE FOR DIE CASTING

[76] Inventors: Harold Booton, 19990 23 Mile Rd., Marshall, Mich. 49068; William C. Caugherty, 8939 Sunglow Ct., Indianapolis, Ind. 46231

[ * ] Notice: The portion of the term of this patent subsequent to May 24, 2011 has been disclaimed.

[21] Appl. No.: 237,067

[22] Filed: May 3, 1994 (Under 37 CFR 1.47)

Related U.S. Application Data

[63] Continuation-in-part of Ser. No. 692,114, Apr. 26, 1991, Pat. No. 5,315,686.

[51] Int. Cl.[6] ..... B67D 5/62; B22D 41/015; B22D 41/05; B22D 35/06

[52] U.S. Cl. ..... 392/480; 222/146.5; 222/593

[58] Field of Search ..... 392/480, 477, 473–476; 219/230, 421; 222/146.5, 590, 591–593

[56] References Cited

U.S. PATENT DOCUMENTS

| | | | |
|---|---|---|---|
| 3,385,294 | 9/1974 | Krohn et al. | 219/517 |
| 4,010,903 | 3/1977 | Sakuri | 239/533.1 |
| 4,196,855 | 4/1980 | Osuna-Diaz | 425/549 |
| 4,386,262 | 5/1983 | Gallert | 219/530 |
| 4,501,952 | 2/1985 | Lehke | 392/491 |
| 4,568,007 | 2/1986 | Fishler | 222/606 |
| 4,635,851 | 1/1987 | Zecman | 239/133 |
| 4,638,849 | 1/1987 | Whitehorn | 164/311 |
| 4,644,140 | 2/1987 | Hillinger | 219/535 |
| 4,898,226 | 2/1990 | Teshima | 222/603 |
| 5,315,686 | 5/1994 | Caugherty et al. | 392/480 |

FOREIGN PATENT DOCUMENTS

| | | |
|---|---|---|
| 3640620A1 | 6/1987 | Germany . |
| 1212823A | 10/1984 | U.S.S.R. . |

*Primary Examiner*—Mark H. Paschall
*Assistant Examiner*—Michael D. Switzer
*Attorney, Agent, or Firm*—Weintraub Duross & Brady

[57] ABSTRACT

An electrically heated nozzle for use in injection molding which is positioned between an injection apparatus and a die casting machine in an injection molding operation. The nozzle transfers molten material such as metal under pressure from the injection apparatus to the die. The nozzle has a refractive core, with a flow passage, surrounded by an intermediate metal core which is heated by a coil of electrical resistance wire to prevent heat loss in the molten metal. A metal sleeve surrounds the coil and the intermediate core. The heating coil is attached to a control box which energizes the coil and controls the temperature.

12 Claims, 2 Drawing Sheets

FIG 1
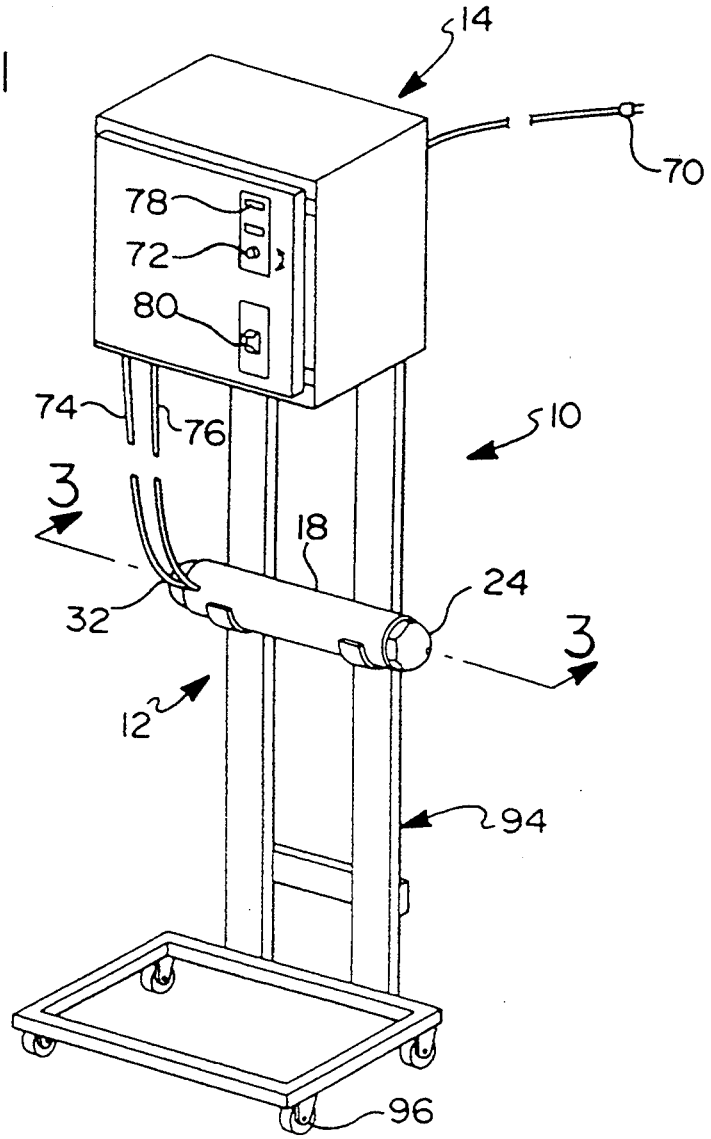
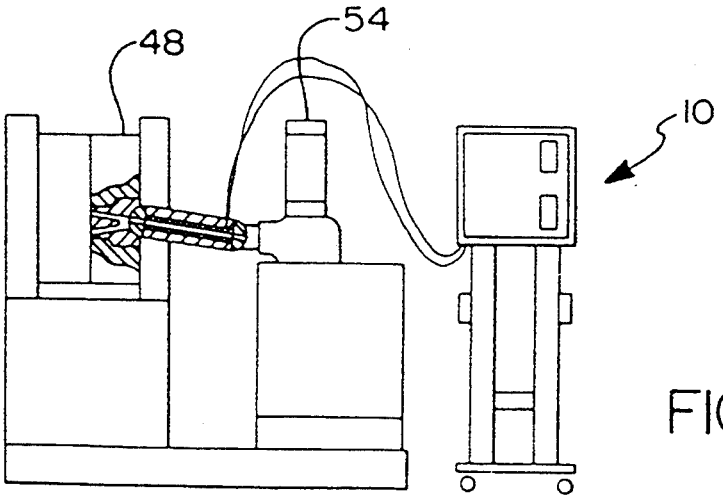
FIG 2

12
18
18a
20
22
24
24a
26
28
30
32
34
36
38
40
42
44
46
52
52a
52b
56
58
60
62
64
66
68
74
76
90
92

ELECTRICALLY HEATED NOZZLE FOR DIE CASTING

RELATED APPLICATIONS

This application is a continuation-in-part of application Ser. No. 07/692,114, filed on Apr. 26, 1991, now U.S. Pat. No. 5,315,686, entitled "Electrically Heated Nozzle for Die Casting" which is incorporated herein by reference.

BACKGROUND OF INVENTION

1. Field of Invention

The present invention is related to electrically heated nozzles for use with die casting. More specifically, to electrically heated nozzles for use with metal die casting.

2. History of Prior Art

The transfer of heated metal to die molds in the die casting industry was accomplished early on by the ladling of the metal to the mold. There was a tendency for the heated metal to cool during transfer which resulted in poor castings. Nozzles were developed to transfer heated metal to a mold through an enclosed device. This was an improvement, but there still was a substantial cooling of the heated metal sufficient to effect the mold. Also, the nozzles were not usable for all kinds of metals. Heated aluminum and magnesium quickly corroded the nozzles making them useless. Therefore, ladling is still in use for corrosive metals.

To overcome heated metal cooling within the nozzles, the nozzles are traditionally heated by using gas torches, such as blow torches. This method causes hot spots, and creates environmental problems, as well as fire hazards.

Efforts, to date, to electrically heat the nozzles have been less than successful. The electrically heated nozzles have been inefficient and expensive to use.

The electrically heated nozzle defined in the copendant application Ser. No. 07/692,114 is a substantial improvement over the prior art. The nozzle is an energy efficient nozzle which reduces heat loss. However, the nozzle, as defined, does not provide for processing the corrosive metals such as aluminum.

A nozzle, which is energy efficient, prevents heat loss, and can process any kind of heated metal under pressure, would provide greater environmental benefits and industrial uses. It is to all these goals that the present invention is directed.

SUMMARY OF THE INVENTION

The present invention, which addresses the above problems, is an electrically heated nozzle for use in transferring heated material from a heated material container to a die mold, the nozzle comprising:

(a) an outer sleeve;

(b) an intermediate core member surrounded by the sleeve, the intermediate core member having an end cap integrally formed therewith;

(c) a refractive core member disposed within the intermediate core member, the refractive core member having a transfer flow passage formed therethrough, the transfer flow passage being a constant diameter throughout the length of the refractive core member;

(d) a nozzle tip, the nozzle tip surrounding the intermediate core member opposite the end cap;

(e) a unitary coil of electrical resistance wire wrapped around the at least a portion of the intermediate core member; and (f) means for regulating electrical current flow through the coil to adjust the temperature of the nozzle.

Preferably, the end cap and the nozzle tip have curved portions which cooperate to permit easy insertion into a furnace and a die mold. The curved portions also permit adjustability for height differences between the dies and furnaces. Further, the nozzle tip is preferably removable from the intermediate core member to permit the intermediate core member to be removed from the outer sleeve.

The coil of electrical resistance wire wrapped around intermediate core member is a unitary coil which has its loops distributed around the intermediate core member in such a way to provide the greatest amount of heat at the end cap portion and the nozzle tip portion. This prevents heat loss where the coil is not in contact with the intermediate core member.

The heat from the coil is transferred through the intermediate core member and the refractive core member to the heated material flowing through the refractive core. Thus preventing heat loss in the heated material.

The refractive core member is, preferably, made from a ceramic, but may be made from fused silicon or a refractive metal, such as Tantalum. The refractive core member is compression fitted within the intermediate core member. The heated material flows through the flow passage of the refractive core member. The refractive core member is not subject to corrosive attack by aluminum and other corrosive metals.

The means for regulating current through the coil preferably comprises a control box which contains a regulating device to set the temperature of the nozzle. Electrical wires connect the control box to the nozzle.

The present invention will be better understood with reference to the following detailed discussion and to the accompanying drawings, in which like reference numerals refer to like elements and in which:

BRIEF DESCRIPTION OF DRAWINGS

FIG. 1 is a perspective view of a nozzle and control box in accordance with the present invention;

FIG. 2 is a side elevational view, partially in cross-section, of a die casting machine and furnace utilizing the nozzle of the present invention;

DETAILED DESCRIPTION OF THE PREFERRED EMBODIMENT

Figures 3, 4, 5, 6:
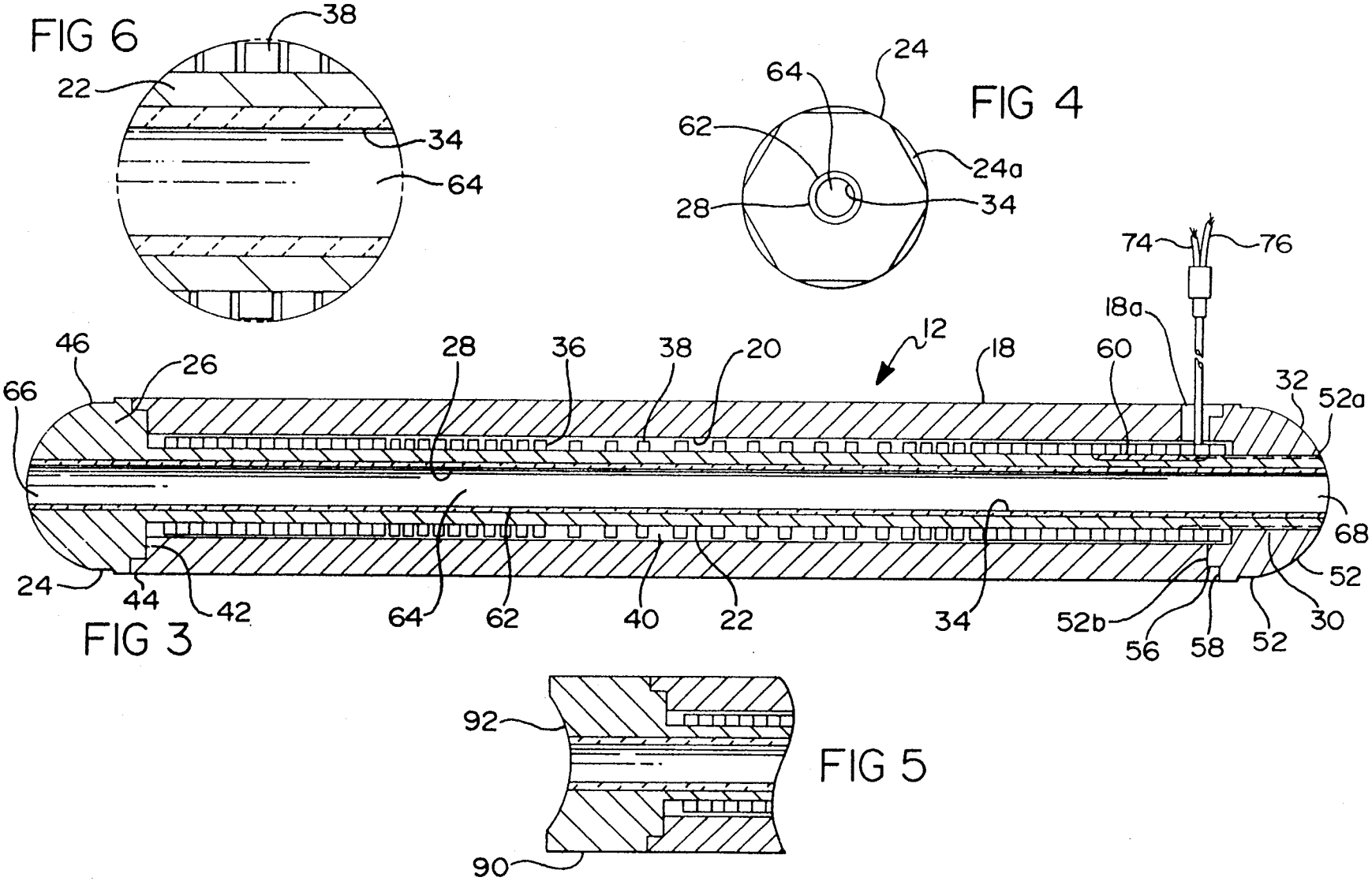
FIG. 3 is a cross-section side view of the nozzle along the line 3—3 of FIG. 1.
FIG. 4 is an end view of the nozzle of FIG. 3.
FIG. 5 is a partial cross-section of an alternative embodiment of a nozzle.
FIG. 6 is a partial cross-section, two times normal size, of a portion of the nozzle.

Now, with reference to the drawings, there is depicted therein an embodiment of the present invention, generally, designated 10, to wit: an electrically heated nozzle assembly 10 for die casting, the nozzle assembly 10 comprising a nozzle 12 and a control box 14 and means 16 for regulating electric current flow to the nozzle 12 disposed within the control box 14 and connected to the nozzle 12.

As shown in FIG. 3, the nozzle 12, preferably, comprises an outer sleeve 18. The outer sleeve 18 being generally a cylindrical shape having a first bore 20 formed therethrough extending the length of the sleeve 18. The outer sleeve 18 is preferably made from metal.

The outer sleeve 18 surrounds an intermediate core member 22. The intermediate core member 22 is generally cylindrically shaped with an end cap 24 integrally formed at a first end 26 of the intermediate core member 22. The intermediate core member 22 preferably has threads formed on a second end 30 for receiving a nozzle tip 32 which is described in greater detail below.

The intermediate core 22 has a electrical resistance heating coil 36 wrapped around substantially the length of the core 22. The loops 38 of the coil 36 around the intermediate core member 22 are distributed in such a manner as to provide the greatest amount of heat at the first and second ends 26, 30 of core member 22. This is accomplished by progressively narrowing the space 40 between the loops 38 with the widest spaces 40 located at the middle of the intermediate core member 22 and the narrowest spaces 40 located near the ends 26, 30.

As shown in FIG. 3, the electrical heating resistance coil 36 may have a substantially square cross-section. The electrical heating resistance coil 36 is generally powered by an electrical power source (not shown). The temperature of the heating resistance coil 36 is regulated by the means 16 for regulating current flow through the coil 36 which is discussed in greater detail below. The means 16 for regulating current flow accesses the heating coil 36 via a notch 18*a* formed in the outer sleeve 18 where the nozzle tip 32 engages the outer sleeve 18.

Distribution of the loops 38 of the heating coil 36 is intended to provide the most heat where it is needed the most, at the ends 26, 30. Also, because of the distribution of the coil 36, less energy is required to heat the coil 36. This makes the nozzle 10 a very efficient heating device.

The end cap 24 of the intermediate core member 22 is formed with an inset shoulder 42 which seats with a flange 44 found on the end of the sleeve 18 for coaxial alignment of the sleeve 18 with the intermediate core member 22. The end cap 24, also, has a first rounded portion 46 formed thereon to permit the nozzle 10 to mate with a furnace 48 or hot material source. As shown in FIG. 3, the rounded portion of the end cap 26 is convex, but may be concave.

The nozzle tip 32, disposed on the second end 30 of the intermediate core member 22, has an internally threaded aperture 50 formed therethrough and is removably attachable to the intermediate core member 22. The nozzle tip 32 has a second rounded portion 52 on a front face 52*a* formed opposite the first rounded portion 46 of the end cap 24 for insertion into a mold 54. As shown in FIG. 3, the rounded portion 52 of the nozzle tip 32 is convex, but may be concave.

The nozzle tip 32 has a second insert shoulder 56 formed on a rear face 52*b* for engagement with a second flange 58 of the sleeve 18. A thermocouple 60 is provided with the nozzle tip 32 to provide data about actual operating temperature of the nozzle 10 to the control box 14.

As shown in FIG. 4, the end cap 24 has a plurality of cut away flattened faces formed around the periphery thereof to allow grasping thereof by a wrench in assembly and disassembly. The nozzle tip 32, also, has similar flattened faces.

As shown in FIG. 3, a refractive core member 34 is disposed within the second bore 28 of the intermediate core member 22. The refractive core member 34 is preferably a ceramic tube 62, but may be made from a fused silica or a refractive metal. The refractive core 34 is molded into the intermediate core 22 to provide protection to the nozzle 10 from corrosive material. Also, the refractive core member 34 cooperates with the intermediate core member 22 to transfer heated material under high pressure.

The refractive core member 34 has a flow passage 64 formed therethrough to receive and transfer heated material. The flow passage 64 has an essentially constant diameter throughout the length of the refractive core member 34. Each end of the refractive core member 34 is formed flush with the rounded end 46 of the end cap 26 and the rounded end 52 of the nozzle tip 32.

The flow passage 64 within the refractive core member 34 has an inlet 66 and an outlet 68 and is generally smooth and unbroken therein for the passage therethrough of molten material in a die casting operation. The inner diameter of the passage 64 is constant throughout the refractive core member 34 to avoid pressure buildup in operation.

The control box 14, which controls and monitors the nozzle 10, houses the means 16 for regulating the electrical current flow to the resistance heating coil 36. The control box 14 is constructed to be powered by a standard industrial current such as 110-volt, 220-volt, etc., and includes a conventional plug 70 for connecting the control box 14 to a power source (not shown). The control box 14 includes an on-off switch 80 disposed thereon for energizing and de-energizing the nozzle 10.

The means 16 for regulating the current flow to the heating coil 36 preferably comprises two sets of wires for communicating with the heating coil 36: a first set 74 for supplying the current and a second set 76 for communicating the thermocouple couple 60 readings. The means 16 for regulating also comprises an indicator 78 to indicate a selected operating temperature of the nozzle. The indicator displays the temperature which corresponds to the setting of a control knob 72. The indicator 78 may also display the actual temperature of the termocouple 60. The control knob 72 moves in the direction of the arrows. The indicator 78 can be an LED numeric display or other type of indicator 78 known to those skilled in the art.

Alternatively, push buttons may be used in place of the knob 72 for more precise temperature control. Also, a suitable microprocessor, housed in the control box 14, may be used to assist in accurately controlling the temperature. Watlow Controls of Winona, Minn., sells such a processor under the name "SERIES 985".

As shown in FIG. 5, a second embodiment of the nozzle 12 has an end cap 90 with a concave rounded surface 92. The nozzle tip (not shown) may also have a concave rounded surface. Further additional embodiments of the nozzle 12 may have an end cap with a convex rounded surface and a nozzle tip with a concave rounded surface or, alternatively, an end cap with a concave rounded surface and a nozzle tip with a convex rounded surface.

In use, the nozzle 12 is disposed between a furnace 48 or heated material container and a die casting machine 54. The heated material is injected through the nozzle 12 under pressure. It is an important feature of the present invention that the nozzle 12 be adjustable for use with die casting machines 54 of differing heights. The rounding of both ends of the nozzle 12 permits the nozzle 12 to be mated with corresponding rounded surfaces in the furnace 48 and the die casting machine 54.

Generally, after the nozzle 12 is seated in place between the furnace 48 and die casting machine 54, the control box 14 is turned on and the nozzle is brought to the desired selected temperature, such as e.g., 1400° F. for heating molten metal. Thus, the molten metal transferred from the furnace 48 to the die casting machine 54 through the nozzle 12 does not lose any heat. A further feature, the distributed heating coil, provides heat through the nozzle 12 by distributing the greatest amount of heat where it is needed most, such as at the ends 26, 30. The molten metal enters the die casting machine 54 at a precisely controlled optimum temperature.

An additional feature of the nozzle 12 is the refractive core 34. In use, the refractive core 34 prevents any molten material from building up in the nozzle 12, corrosive material from damaging the nozzle 12 and withstands any great pressure build-up.

Serviceability is enhanced by the easily removable nozzle tip 32 allowing access to the termocouple 60 and the heating coil 36 within the nozzle 12. As shown in FIG. 1, the assembly 10 may include a stand 94, which may, optionally, be mounted on a plurality of wheels 96 to enhance portability thereof. The stand 94 may also include curved brackets for resting the nozzle 12 thereon when not in use. The control box 14 is preferably removably mounted to the stand 94 by mounting hardware which is known by those skilled in the art.

Having thus described the invention what is claimed is:

1. A nozzle assembly for use in transferring a heated material, the nozzle assembly comprising:

(a) an outer sleeve;

(b) an intermediate core member having an end cap formed on a first end, the intermediate core member being surrounded by the outer sleeve, the intermediate core member having a bore formed therethrough, the bore being a constant diameter throughout the length of the intermediate core member, the end cap having a rounded portion;

(c) a refractive core member disposed within the bore of the intermediate core member, the refractive core member having a transfer flow-passage formed therethrough, the transfer flow-passage being a constant diameter throughout the length of the refractive core member and having an inlet and an outlet;

(d) a nozzle tip, the nozzle tip surrounding the intermediate core proximate a second end opposite the end cap, the nozzle tip having a rounded portion aligned with and opposite the rounded portion of the end cap;

(e) a unitary coil of electrical resistance wire wrapped around at least a portion of the intermediate core member;

(f) means for regulating current flow through the coil to adjust the temperature of the nozzle; and wherein the curved portions of the nozzle cooperate to permit for east insertion into a furnace and to permit adjustability for varying die heights.

2. The nozzle assembly of claim 1, further comprising means for indicating a temperature corresponding to a particular setting of the means for regulating the current flow through the heater wire.

3. The nozzle assembly of claim 1, further comprising a control box which contains the means for regulating current flow through the coil, and a pair of wires connecting the nozzle with the control box.

4. The nozzle assembly of claim 1, wherein the unitary coil comprises:

a plurality of distributed wound coil loops surrounding the intermediate core member, the distance between the coil loops reducing from the center of the intermediate core toward the ends.

5. The nozzle of claim 1, wherein the refractive core member is a ceramic material.

6. The nozzle of claim 1, wherein the refractive core member is a fused silica material.

7. The nozzle of claim 1, wherein the refractive core member is a refractory metal.

8. The nozzle assembly of claim 1, further comprising an end cap, the end cap integral and coaxial with the sleeve and having a portion of the bore formed therein for receiving a portion of the refractive core member, the end cap having a concave surface formed thereon coaxial with the flow passage of the refractive core member for engagement with a source of material to be injected into a die.

9. The nozzle assembly of claim 1, wherein the rounded portion of the end cap is concave.

10. The nozzle assembly of claim 1, wherein the rounded portion of the end cap is convex.

11. The nozzle assembly of claim 1, wherein the rounded portion of the nozzle tip is convex.

12. The nozzle assembly of claim 8, further comprising:

(a) a control box, the means for adjusting current flow to the coil being housed in the control box;

(b) a pair of wires connecting the coil to the control box;

(c) an on-off switch disposed on the control box for energizing and de-energizing the nozzle; and (d) means for indicating a selected temperature of the nozzle disposed on the control box.

* * * * *